US005762282A

United States Patent [19]

Wolner

[11] Patent Number: 5,762,282

[45] Date of Patent: Jun. 9, 1998

[54] REMOTE RETRACTABLE LIFELINE EXTENDER

[75] Inventor: J. Thomas Wolner, Red Wing, Minn.

[73] Assignee: D B Industries, Inc., Red Wing, Minn.

[21] Appl. No.: 328,316

[22] Filed: Oct. 24, 1994

[51] Int. Cl.[6] ..... B65H 75/48; B65H 20/00; A62B 1/06

[52] U.S. Cl. ..... 242/390.8; 242/390.9; 242/381; 182/73; 226/143; 226/190; 254/364

[58] Field of Search ..... 242/390.8, 390.9, 242/394.1, 383, 381, 47.01; 182/73; 226/143, 190; 254/364, 333

[56] References Cited

U.S. PATENT DOCUMENTS

| | | | |
|---|---|---|---|
| 1,575,344 | 3/1926 | Klein | 182/73 |
| 3,110,439 | 11/1963 | Drake | 226/143 X |
| 3,760,910 | 9/1973 | Koshihara | 188/180 |
| 3,844,377 | 10/1974 | Wilkins | 182/73 |
| 4,511,123 | 4/1985 | Ostrobrod | 254/364 |
| 4,611,688 | 9/1986 | Sekhar | 182/237 |
| 4,653,609 | 3/1987 | Devine | 182/238 |
| 5,186,289 | 2/1993 | Wolner et al. | 188/180 |
| 5,388,781 | 2/1995 | Sauber | 242/390.8 X |

*Primary Examiner*—John Q. Nguyen
*Attorney, Agent, or Firm*—Moore & Hansen

[57] ABSTRACT

A remotely controllable retractable lifeline extender having an electric motor attached thereto to provide powered payout and retraction of the lifeline to a user located below. The remote retractable lifeline extender may be fastened to the ceiling or rafter of a structure, or to some other sturdy structural component thereof having a great deal of clearance below the connection point. The device is actuated by a hand-held remote control unit used by the worker to be attached to the lifeline. By activating the remote control unit, the lifeline is lowered to the worker by the motor-powered unit. The lifeline is attached to the worker's safety belt or harness by a fastening member such as a locking snap hook or carabiner. When the worker completes the job and is finished with the lifeline, the lifeline is disconnected from the worker's safety belt or harness, and the remote control unit is again activated to cause the motor-powered unit to retrieve the lifeline and rewind it into the retractable lifeline housing.

36 Claims, 4 Drawing Sheets

REMOTE RETRACTABLE LIFELINE EXTENDER

BACKGROUND OF THE INVENTION

1. Technical Field

The present invention relates generally to fall arresting devices, and particularly to a fall arresting device that provides remote actuation of the line lowering and retrieving mechanism.

2. Background Information

Retractable lifelines are commonly known for use as fall protection devices for workers located high above the ground. In the event of a fall, these devices rely on a braking system to gradually bring the worker to a stop without subjecting the worker to the sudden jolt that would result from reaching the end of a fixed rope or cable. These devices reduce the likelihood and severity of injuries. A retractable lifeline of this type is disclosed in U.S. Pat. No. 5,186,289, issued to Wolner et al. on Feb. 16, 1993. These devices may also include hand cranks for raising or lowering the worker to a platform or the ground once the worker's fall has been stopped.

A major deficiency of retractable lifelines has been that they must be within easy reach to be effective. The worker must be able to reach the cable, and the snap hook frequently fastened to the end thereof, and attach the cable to the safety belt or harness worn by the worker. However, if the worker is in a building with a very high ceiling, such as an airplane hangar, a device of this type is not useful because the retractable lifeline, which must be anchored to a sturdy, preferably immovable object, is too far away. In such cases, workers may be required to suspend themselves from the raised platform of a forklift or other type of portable crane. While perhaps adequate for a particular limited purpose, the use of a crane as a safety device is generally not preferable, and is usually not considered an optimal allotment of the resources available at a construction or manufacturing location. Additionally, where retractable lifeline assemblies are provided in work areas with high ceilings, it is not safe to leave the lines dangling to put them within easy reach of the workers, because they may become entangled with or damaged by large pieces of machinery or other equipment moving about the work area.

The remote retractable lifeline extender of the present invention overcomes difficulties described above and affords other features and advantages heretofore not available.

SUMMARY OF THE INVENTION

The preferred embodiment of the present invention provides a retractable lifeline having an electric motor attached thereto to provide powered payout and retraction of the lifeline to a user located below. The remote retractable lifeline extender may be fastened to the ceiling or rafter of a structure, or to some other sturdy, structural component thereof having a great deal of clearance below the connection point. The device is actuated by a hand-held remote control unit used by the worker to be attached to the lifeline.

By activating the remote control unit, the lifeline is lowered to the worker by the motor-powered unit. The lifeline is attached to the worker's safety belt or harness by a fastening member such as a locking snap hook or carabiner. When the worker completes the job and is finished with the lifeline, the lifeline is disconnected from the worker's safety belt or harness, and the remote control unit is again activated to cause the motor-powered unit to retrieve the lifeline and rewind it into the retractable lifeline housing.

It is an object of this invention to provide a safe, secure device for the protection of workers located far above the ground, with a high ceiling or other overhead structure above them. It is a further object of this invention that this device should be remotely controlled by the worker using the device for easy attachment thereto.

Other objects and advantages of the invention will become apparent from the following detailed description and from the appended drawings in which like numbers have been used to describe like parts throughout the several views.

DESCRIPTION OF THE PREFERRED EMBODIMENT

Figure 1:
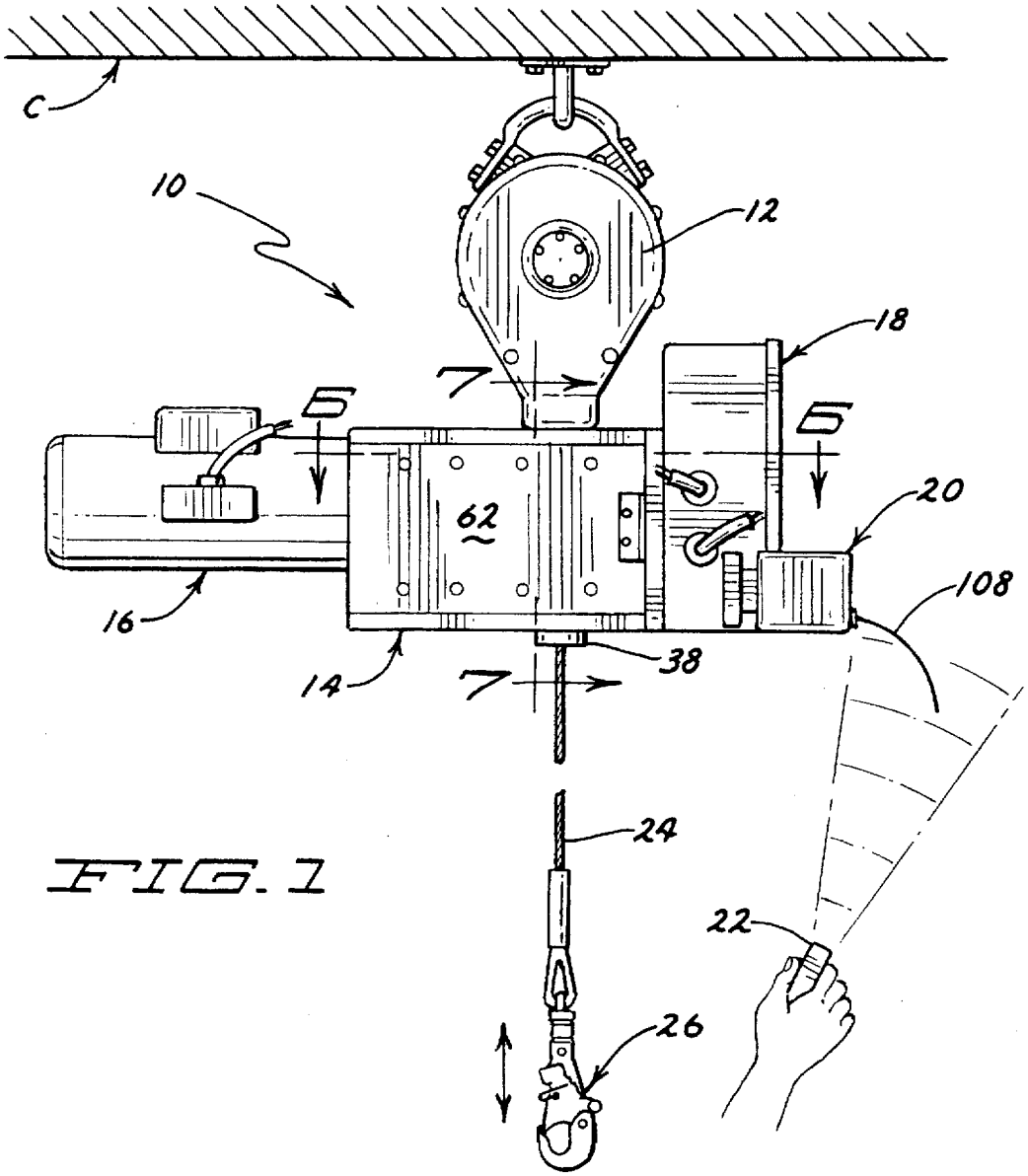
FIG. 1 is a front view of the remote retractable lifeline extender of the present invention.
Figure 2:
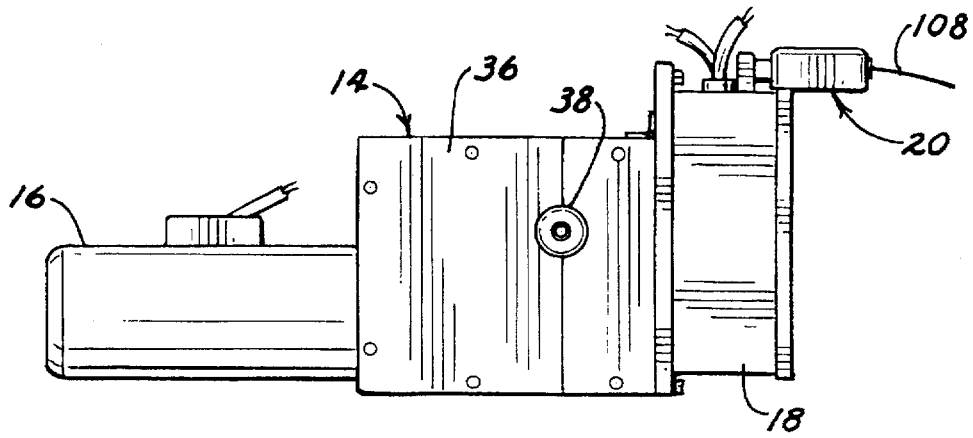
FIG. 2 is a bottom view of the retractable lifeline extender.
Figure 4:
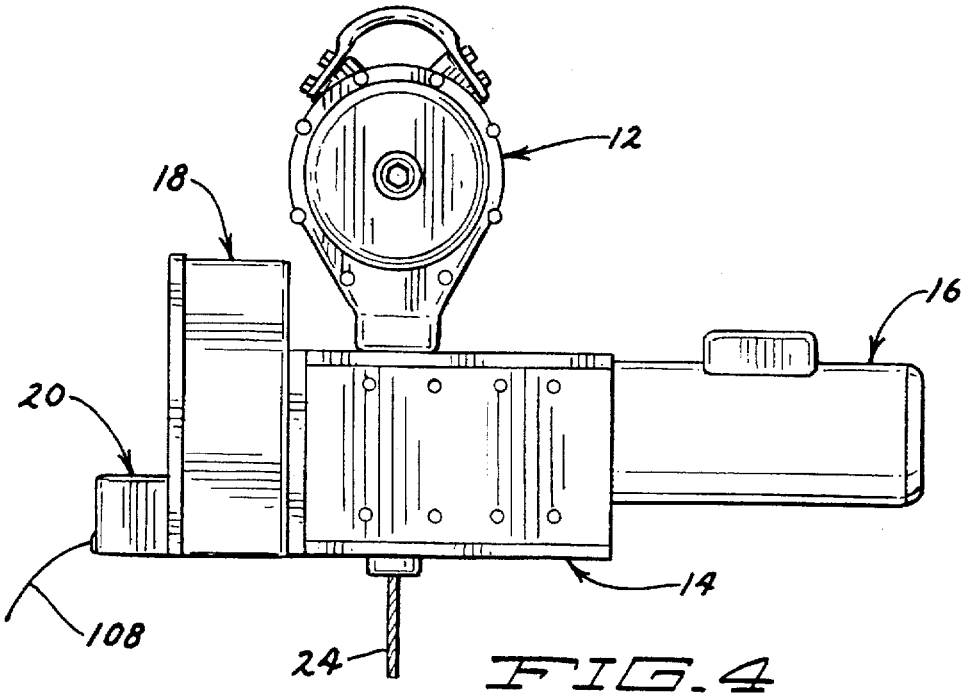
FIG. 4 is a rear view of the retractable lifeline extender.
Figure 3:
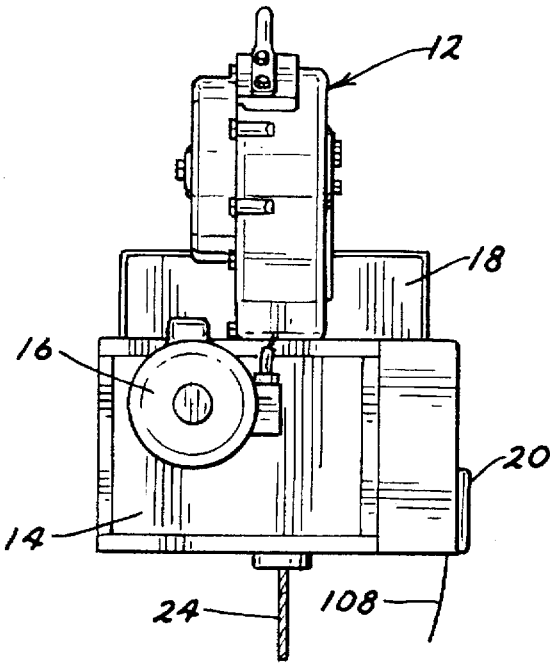
FIG. 3 is a left side elevation of the retractable lifeline extender.
Figure 5:
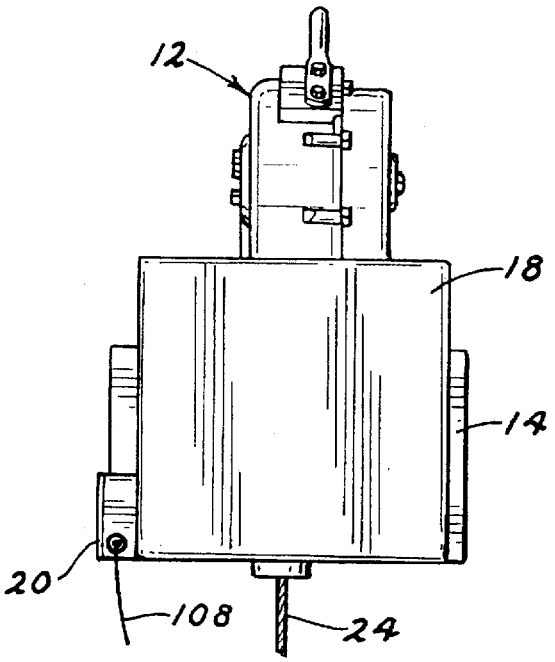
FIG. 5 is a right side elevation of the retractable lifeline extender.

With reference to the drawings, and in particular to FIG. 1, the remote retractable lifeline extender assembly is generally indicated by reference numeral 10. This assembly includes a retractable lifeline safety device 12 adapted for use with the assembly, a variety of such retractable lifeline safety devices being commercially available. The assembly also includes a mechanical housing 14, a motor 16, an electronics housing 18 and a receiver 20. Remote retractable lifeline extender 10 is actuated by handheld transmitter 22.

The operation of retractable lifeline safety device 12 is known in the industry. In effect, safety line 24, which is preferably a 3/16 inch steel cable, is attached to a worker by means of a carabiner or locking snap hook 26. When the worker moves about as part of the ordinary motion of performing the work, safety line 24 is paid out from a spool (not shown) in the housing of retractable lifeline safety device 12. Since the spool therein is spring loaded, constant tension is maintained on safety line 24, and excess or slack amounts are rewound onto the spool. In the event of a fall, however, the sudden downward force on safety line 24 actuates a brake within retractable lifeline safety device 12 that causes the spool to quickly, but not suddenly, stop paying out additional lengths of safety line 24. This braking mechanism thereby brings the falling worker to a stop before reaching the ground but without causing the sudden jolt that can itself injure the worker.

Figure 6:
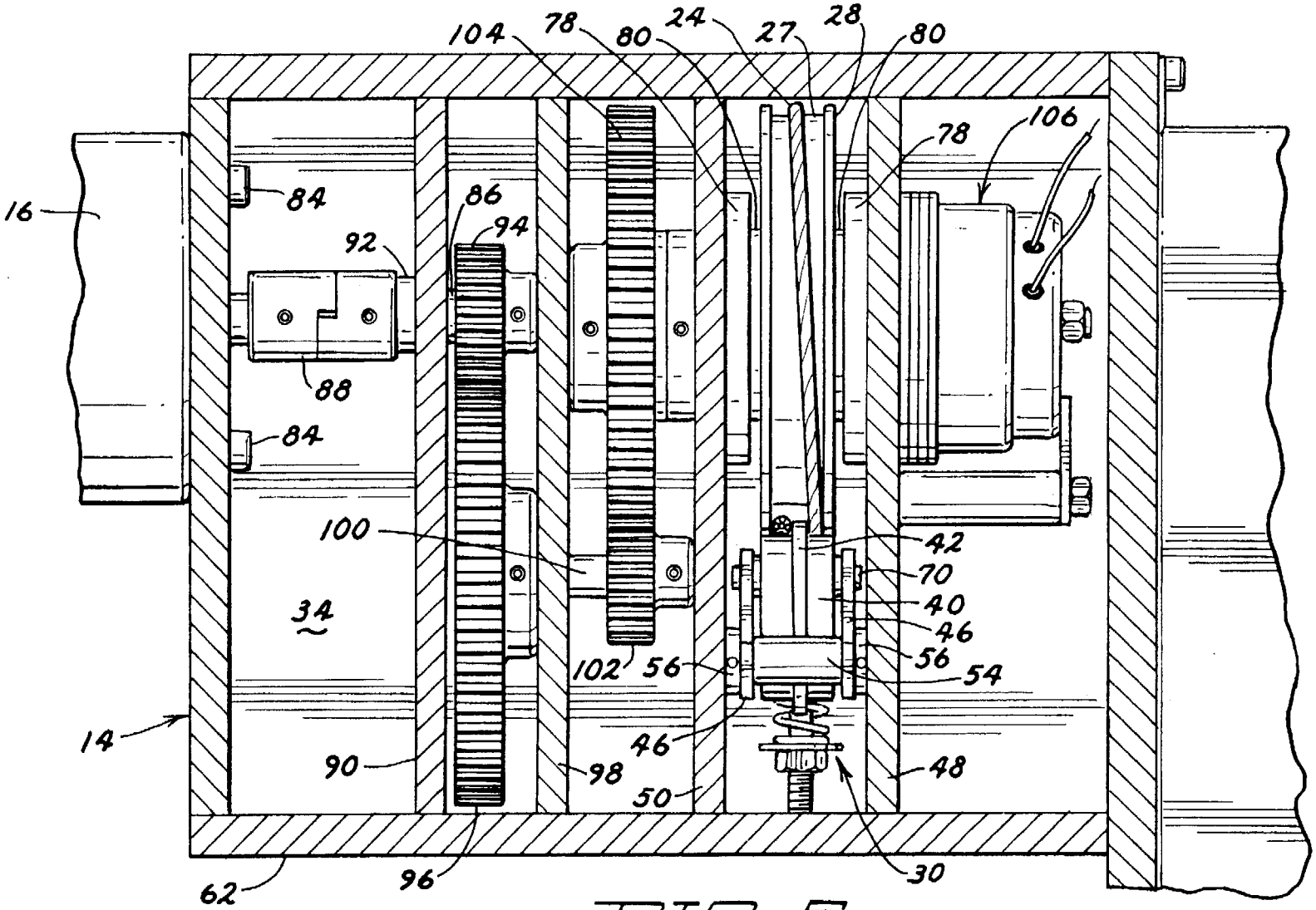
FIG. 6 is a sectional view of the retractable lifeline extender taken along line 6—6 of FIG. 1.
Figure 7:
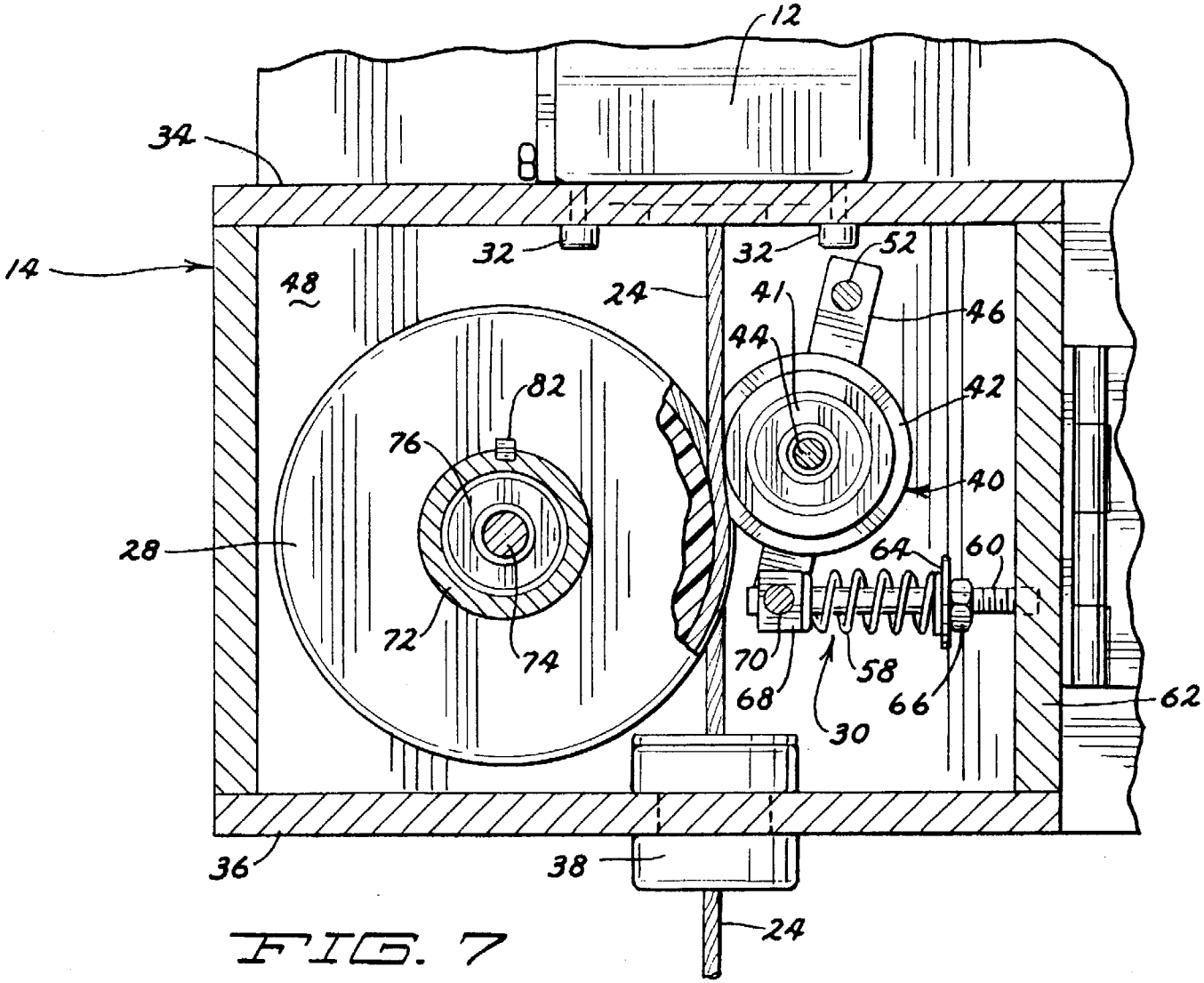
FIG. 7 is a side sectional view of the retractable lifeline extender taken along line 7—7 of FIG. 1.

As shown in FIG. 1, remote retractable lifeline extender 10 is preferably suspended from a structure such as a ceiling C or other secure structure such as a rafter or overhead beam. Referring to FIGS. 6 and 7, in the present invention, safety line 24 passes through mechanical housing 14, where it is wrapped once around the peripheral channel 27 of cable wheel 28, within which it is retained by tensioning mechanism 30. Cable wheel 28 preferably has a steel core with a rubber surface bonded to it to more securely engage safety line 24 without slippage. As shown in FIG. 7, retractable lifeline safety device 12 is attached as by bolts 32 to the upper wall 34 of mechanical housing 14. Safety line 24 passes through an opening in upper wall 34 (not shown), wraps around cable wheel 28, and then passes through an opening in lower wall 36 defined by cable guide 38.

As noted, safety line 24 is maintained in contact with cable wheel 28 by tensioning mechanism 30. Tensioning mechanism 30 includes a pressure roller 40 having a peripheral rib 42. A bearing 41 is positioned between pressure roller 40 and roller shaft 44, about which pressure roller 40 rotates, and which is mounted on its ends to roller brackets 46. Tensioning mechanism 30 is pivotally attached to first and second inner walls 48, 50, respectively, of mechanical housing 14 by roller pivot 52. A pivot spacer 54 extends about the periphery of roller pivot 52 between roller brackets 46 to maintain the proper spacing between them. Pivot collars 56 are positioned between roller brackets 46 and first and second inner walls 48, 50 to maintain proper spacing therebetween. Tensioning mechanism 30 is biased against cable wheel 28 and safety line 24 by spring 58, which is mounted to threaded rod 60 which in turn threadedly engages front wall 62 of mechanical housing 14. One end of spring 58 may bear against washer 64 held in position by nut 66, and the other end bears against spring pivot 68. Spring pivot 68 threadedly engages the other end of threaded rod 60, and includes projecting members 70 that pivotally engage another set of opposed openings in roller brackets 46.

Cable wheel 28 is mounted within mechanical housing 14 on wheel hub 72 within which passes spring-loaded clutch shaft 74. Between wheel hub 72 and clutch shaft 74 are positioned one or more bearings 76. Additionally, wheel hub 72 itself passes within two bearings 78 positioned within openings in first and second inner walls 48, 50. Cable wheel 28 is properly positioned between bearings 78 by two hub spacers 80. Wheel hub 72 is caused to rotate with cable wheel 28 by woodruff key 82.

The rotation of cable wheel 28 is motivated by motor 16 affixed to mechanical housing 14 as by bolts 84. Motor 16 is coupled to drive shaft 86 by coupling body 88, which is spaced from fourth inner wall 90 by shim 92. Drive shaft 86 passes through a bearing (not shown) in an opening in fourth inner wall 90, and turns first small diameter spur gear 94, which in turn engages first large diameter spur gear 96. The end of drive shaft 86 rotates within and is supported by another bearing (not shown) in an opening in third inner wall 98. First large diameter spur gear 96 drives gear shaft 100, which passes through a bearing (not shown) in an opening in third inner wall 98, and turns second small diameter spur gear 102, which in turn engages second large diameter spur gear 104. The ends of gear shaft 100 rotate and are supported by bearings (not shown) within fourth and second inner walls 90, 50, respectively.

Second large diameter spur gear 104 is attached to and turns clutch shaft 74, to which cable wheel 28 is mounted. Thus, actuation of motor 16 results in the paying out or retraction of safety line 24. Keyed to the end of clutch shaft 74 is an electromagnetic clutch assembly 106. The opposite end of clutch shaft 74 passes through a spring (not shown). Clutch shaft 74 passes through openings in third and fourth inner walls 90, 98, and the spring on the end thereof bears against second large diameter spur gear 104 on one end and a washer that prevents it from passing through the opening in fourth inner wall 90 on the other. Thus, upon rewinding safety line 24, for example, to prevent damage to remote retractable lifeline extender 10, electromagnetic clutch assembly 106 permits slippage of wheel hub 72 about clutch shaft 74, in turn permitting stoppage of the rotation of cable wheel 28 until motor 16 stops rotation of drive shaft 86.

In operation, remote retractable lifeline extender 10 is actuated by handheld remote control unit 22, which includes an up button for retraction of safety line 24 into retractable lifeline safety device 12 and a down button for extension of safety line 24 therefrom. The signal transmitted from transmitter 22 is received by an antenna 108 projecting from receiver unit 20. Receiver 20 communicates with the controlling electronics located in electronics housing 18, which control the operation of the remote retractable lifeline extender 10. Upon receipt of a "down" signal from transmitter 22, motor 16 is actuated to extend safety line 24 from retractable lifeline safety device 12. Motor 16 continues to turn drive shaft 86 until the "down" button of transmitter 22 is released by the user. At that point, a time delay, preferably of approximately five seconds, is provided to prevent cable wheel 28 from turning while the safety line is attached to the worker. At the end of the time delay, cable wheel 28 may rotate freely, and the fall arrest function of the retractable lifeline safety device 12 controls the operation of remote retractable lifeline extender 10.

When the worker no longer needs safety line 24, it may be retracted by pressing the "up" button on transmitter 22. Motor 16 will be actuated to retract safety line 24 until the "up" button is released. If the "up" button is held even after the line is fully retracted, electromagnetic clutch assembly 106 will prevent rotation of cable wheel 28 until the button is released. Alternatively, a transmitter with only a "down" button may be provided, and safety line 24 may be retracted by releasing it after placing it in a fall arrest mode by pulling quickly on the line to simulate a fall. Retractable lifeline safety device 12 will then quickly retract safety line 24. To avoid damage to remote retractable lifeline extender 10, the "down" button may be pressed periodically during the ascent of safety line 24 to slow the retraction process.

While the preferred embodiments of the invention have been described, it should be understood that various changes, adaptations and modifications may be made therein without departing from the spirit of the invention and the scope of the appended claims.

What is claimed is:

1. A remotely controllable retractable lifeline extending safety device, comprising:

a retractable lifeline safety device containing an extendable lifeline;

a lifeline extension assembly cooperative with said lifeline safety device for extending said lifeline therefrom and rewinding said lifeline thereto, said lifeline extension assembly being contained within a housing attached to said retractable lifeline safety device;

a motor engageable with said lifeline extension assembly for powering said lifeline extension assembly;

a drive linkage rotatably linking said motor and said lifeline extension assembly;

a receiver and a controlling means mounted in close proximity to said motor for receiving a radio signal for actuation of said motor via said controlling means; and a remotely operable transmitter for sending a radio signal to said receiver for actuation of said motor.

2. The remotely controllable retractable lifeline extending safety device disclosed in claim 1, further comprising:

means for attaching the remotely controllable retractable lifeline extending safety device to an overhead support structure.

3. The remotely controllable retractable lifeline extending safety device disclosed in claim 1, wherein said drive linkage further comprises:

clutch means cooperative between said motor and said lifeline extension assembly permitting said lifeline extension assembly to stop rewinding said lifeline before said motor is disengaged and after said lifeline is fully rewound into said retractable lifeline safety device.

4. The remotely controllable retractable lifeline extending safety device disclosed in claim 3, wherein said clutch means further comprises:

a clutch shaft integral with said drive linkage, said clutch shaft being directly linked to said lifeline extension assembly; and an electromagnetic clutch assembly attached to said clutch shaft, said electromagnetic clutch assembly permitting disengagement of said lifeline extension assembly during rotation of said clutch shaft until said motor stops rotation of said drive linkage.

5. The remotely controllable retractable lifeline extending safety device disclosed in claim 1, wherein said lifeline extension assembly further comprises:

urging means for urging said lifeline alternately toward and away from said retractable lifeline safety device, said urging means being engageable with said motor; and tensioning means bearing against said urging means for retaining said lifeline in contact therewith.

6. The remotely controllable retractable lifeline extending safety device disclosed in claim 5, wherein said urging means further comprises:

a cable wheel having a peripheral channel, said cable wheel being attached to said drive linkage, said lifeline being retained within said peripheral channel by said tensioning means.

7. The remotely controllable retractable lifeline extending safety device disclosed in claim 6, wherein said tensioning means further comprises:

first and second roller brackets, each said roller bracket having a first end and a second end, respectively;

a roller pivot rotatably engaging and extending between said first end of each said roller bracket and attached to said lifeline extension assembly housing, permitting pivotal movement of said tensioning means relative to said lifeline extension assembly housing;

a pressure roller having a peripheral rib, said pressure roller being attached to and positioned between an intermediate portion of each said roller brackets, said peripheral rib contacting and bearing against said lifeline passing through said channel of said cable wheel;

a pivot spacer peripherally mounted to said roller pivot and extending between said second end of each said roller bracket; and a spring biasing assembly attached to and bearing against said pivot spacer, said spring biasing assembly including a rod passing through a spring biasing member, said rod being attached to said lifeline extension assembly housing.

8. The remotely controllable retractable lifeline extending safety device disclosed in claim 1, wherein said drive linkage further comprises:

a drive shaft coupled to said motor; and gear means positioned between said motor and said cable wheel for adjusting the rotational speed of said cable wheel, said gear means engaged by and being driven by said drive shaft.

9. The remotely controllable retractable lifeline extending safety device disclosed in claim 8, wherein said gear means further comprises:

at least one gear member, said at least one gear member engaged by and being driven by said drive shaft; and at least one gear shaft, said at least one gear shaft engaged by and being driven by said at least one gear member, each said gear member driving a said gear shaft.

10. The remotely controllable retractable lifeline extending safety device disclosed in claim 9, wherein said gear means further comprises:

a first small diameter spur gear mounted to said drive shaft;

a first large diameter spur gear engaged by and driven by said first small diameter spur gear, said first large diameter spur gear having a first gear shaft projecting therefrom;

a second small diameter spur gear mounted to the distal end of said first gear shaft; and a second large diameter spur gear driven by said second small diameter spur gear, said second large diameter spur gear engageable with said lifeline extension assembly.

11. The remotely controllable retractable lifeline extending safety device disclosed in claim 10, wherein said drive linkage further comprises:

clutch means cooperative between said motor and said lifeline extension assembly permitting said lifeline extension assembly to stop rewinding said lifeline before said motor is disengaged and after said lifeline is fully rewound into said retractable lifeline safety device.

12. The remotely controllable retractable lifeline extending safety device disclosed in claim 11, wherein said clutch means further comprises:

a clutch shaft projecting from said second large diameter spur gear; and an electromagnetic clutch assembly attached to said clutch shaft, said electromagnetic clutch assembly permitting disengagement of said lifeline extension assembly during rotation of said clutch shaft until said motor stops rotation of said drive linkage.

13. The remotely controllable retractable lifeline extending safety device disclosed in claim 12, wherein said lifeline extension assembly further comprises:

urging means for urging said lifeline alternately toward and away from said retractable lifeline safety device, said urging means being engageable with said clutch shaft; and tensioning means bearing against said urging means for retailing said lifeline in contact therewith.

14. The remotely controllable retractable lifeline extending safety device disclosed in claim 13, wherein said urging means further comprises:

a cable wheel having a peripheral channel, said cable wheel being attached to said clutch shaft of said drive linkage said lifeline being retained within said peripheral channel by said tensioning means.

15. The remotely controllable retractable lifeline extending safety device disclosed in claim 14, wherein said tensioning means further comprises:

first and second roller brackets, each said roller bracket having a first end and a second end, respectively;

a roller pivot rotatably engaging and extending between said first end of each said roller bracket and attached to said lifeline extension assembly housing, permitting pivotal movement of said tensioning means relative to said lifeline extension assembly housing;

a pressure roller having a peripheral rib, said pressure roller being attached to and positioned between an intermediate portion of each said roller brackets, said peripheral rib contacting and bearing against said lifeline passing through said channel of said cable wheel;

a pivot spacer peripherally mounted to said roller pivot and extending between said second end of each said roller bracket; and a spring biasing assembly attached to and bearing against said pivot spacer, said spring biasing assembly including a rod passing through a spring biasing member, said rod being attached to said lifeline extension assembly housing.

16. The remotely controllable retractable lifeline extending safety device disclosed in claim 15, wherein said lifeline extension assembly housing further comprises:

a front wall, a rear wall, a first end wall and a second end wall; and first, second, third and fourth inner walls, said inner walls extending between and attached to said front and rear walls, said inner walls positioned to support said lifeline extension assembly and said drive linkage within said lifeline extension assembly housing.

17. The remotely controllable retractable lifeline extending safety device disclosed in claim 16, wherein:

said electromagnetic clutch assembly is fixedly mounted to said first inner wall;

said clutch shaft, to which said cable wheel is mounted, passes through a first bearing means supported by said first inner wall and engages said electromagnetic clutch assembly, and passes through a second bearing means supported by said second inner wall and engages said second large diameter spur gear;

said first gear shaft passes through a third bearing means supported by said third inner wall; and said drive shaft passes through a fourth bearing means supported by said fourth inner wall.

18. The remotely controllable retractable lifeline extending safety device disclosed in claim 17, wherein:

said roller pivot engages said first inner wall and said second inner wall of said lifeline extension assembly housing.

19. A remotely controllable retractable lifeline extending safety device having a retractable lifeline safety device containing an extendable lifeline, comprising:

a lifeline extension assembly cooperative with the lifeline safety device for extending the lifeline therefrom and rewinding the lifeline thereto, said lifeline extension assembly being contained within a housing attached to the retractable lifeline safety device;

a motor engageable with said lifeline extension assembly for powering said lifeline extension assembly;

a drive linkage rotatably linking said motor and said lifeline extension assembly;

a receiver and a controlling means mounted in close proximity to said motor for receiving a radio signal for actuation of said motor via said controlling means; and a remotely operable transmitter for sending a radio signal to said receiver for actuation of said motor.

20. The remotely controllable retractable lifeline extending safety device disclosed in claim 19, further comprising:

means for attaching the remotely controllable retractable lifeline extending safety device to an overhead support structure.

21. The remotely controllable retractable lifeline extending safety device disclosed in claim 19, wherein said drive linkage further comprises:

clutch means cooperative between said motor and said lifeline extension assembly permitting said lifeline extension assembly to stop rewinding the lifeline before said motor is disengaged and after the lifeline is fully rewound into the retractable lifeline safety device.

22. The remotely controllable retractable lifeline extending safety device disclosed in claim 21, wherein said clutch means further comprises:

a clutch shaft integral with said drive linkage, said clutch shaft being directly linked to said lifeline extension assembly; and an electromagnetic clutch assembly attached to said clutch shaft, said electromagnetic clutch assembly permitting disengagement of said lifeline extension assembly during rotation of said clutch shaft until said motor stops rotation of said drive linkage.

23. The remotely controllable retractable lifeline extending safety device disclosed in claim 19, wherein said lifeline extension assembly further comprises:

urging means for urging the lifeline alternately toward and away from the retractable lifeline safety device, said urging means being engageable with said motor; and tensioning means bearing against said urging means for retaining the lifeline in contact therewith.

24. The remotely controllable retractable lifeline extending safety device disclosed in claim 23, wherein said urging means further comprises:

a cable wheel having a peripheral channel, said cable wheel being attached to said drive linkage, the lifeline being retained within said peripheral channel by said tensioning means.

25. The remotely controllable retractable lifeline extending safety device disclosed in claim 24, wherein said tensioning means further comprises:

first and second roller brackets, each said roller bracket having a first end and a second end, respectively;

a roller pivot rotatably engaging and extending between said first end of each said roller bracket and attached to said lifeline extension assembly housing, permitting pivotal movement of said tensioning means relative to said lifeline extension assembly housing;

a pressure roller having a peripheral rib, said pressure roller being attached to and positioned between an intermediate portion of each said roller brackets, said peripheral rib contacting and bearing against the lifeline passing through said channel of said cable wheel;

a pivot spacer peripherally mounted to said roller pivot and extending between said second end of each said roller bracket; and a spring biasing assembly attached to and bearing against said pivot spacer, said spring biasing assembly including a rod passing through a spring biasing member, said rod being attached to said lifeline extension assembly housing.

26. The remotely controllable retractable lifeline extending safety device disclosed in claim 19, wherein said drive linkage further comprises:

a drive shaft coupled to said motor; and gear means positioned between said motor and said cable wheel for adjusting the rotational speed of said cable wheel, said gear means engaged by and being driven by said drive shaft.

27. The remotely controllable retractable lifeline extending safety device disclosed in claim 26, wherein said gear means further comprises:

at least one gear member, said at least one gear member engaged by and being driven by said drive shaft; and at least one gear shaft, said at least one gear shaft engaged by and being driven by said at least one gear member, each said gear member driving a said gear shaft.

28. The remotely controllable retractable lifeline extending safety device disclosed in claim 27, wherein said gear means further comprises:

a first small diameter spur gear mounted to said drive shaft;

a first large diameter spur gear driven by said first small diameter spur gear, said first large diameter spur gear having a first gear shaft projecting therefrom;

a second small diameter spur gear mounted to the distal end of said first gear shaft; and a second large diameter spur gear engaged by and driven by said second small diameter spur gear, said second large diameter spur gear engageable with said lifeline extension assembly.

29. The remotely controllable retractable lifeline extending safety device, disclosed in claim 28, wherein said drive linkage further comprises:

clutch means cooperative between said motor and said lifeline extension assembly permitting said lifeline extension assembly to stop rewinding the lifeline before said motor is disengaged and after the lifeline is fully rewound into the retractable lifeline safety device.

30. The remotely controllable retractable lifeline extending safety device disclosed in claim 29, wherein said clutch means further comprises:

a clutch shaft projecting from said second large diameter spur gear; and an electromagnetic clutch assembly attached to said clutch shaft, said electromagnetic clutch assembly permitting disengagement of said lifeline extension assembly during rotation of said clutch shaft until said motor stops rotation of said drive linkage.

31. The remotely controllable retractable lifeline extending safety device disclosed in claim 30, wherein said lifeline extension assembly further comprises:

urging means for urging the lifeline alternately toward and away from the retractable lifeline safety device, said urging means being engageable with said clutch shaft; and tensioning means bearing against said urging means for retaining the lifeline in contact therewith.

32. The remotely controllable retractable lifeline extending safety device disclosed in claim 31, wherein said urging means further comprises:

a cable wheel having a peripheral channel, said cable wheel being attached to said clutch shaft of said drive linkage, the lifeline, being retained within said peripheral channel by said tensioning means.

33. The remotely controllable retractable lifeline extending safety device disclosed in claim 32, wherein said tensioning means further comprises:

first and second roller brackets, each said roller bracket having a first end and a second end, respectively;

a roller pivot rotatably engaging and extending between said first end of each said roller bracket and attached to said lifeline extension assembly housing, permitting pivotal movement of said tensioning means relative to said lifeline extension assembly housing;

a pressure roller having a peripheral rib, said pressure roller being attached to and positioned between an intermediate portion of each said roller brackets, said peripheral rib contacting and bearing against the lifeline passing through said channel of said cable wheel;

a pivot spacer peripherally mounted to said roller pivot and extending between said second end of each said roller bracket; and a spring biasing assembly attached to and bearing against said pivot spacer, said spring biasing assembly including a rod passing through a spring biasing member, said rod being attached to said lifeline extension assembly housing.

34. The remotely controllable retractable lifeline extending safety device disclosed in claim 33, wherein said lifeline extension assembly housing further comprises:

a front wall, a rear wall, a first end wall and a second end wall; and first, second, third and fourth inner walls, said inner walls extending between and attached to said front and rear walls, said inner walls positioned to support said lifeline extension assembly and said drive linkage within said lifeline extension assembly housing.

35. The remotely controllable retractable lifeline extending safety device disclosed in claim 34, wherein:

said electromagnetic clutch assembly is fixedly mounted to said first inner wall;

said clutch shaft, to which said cable wheel is mounted, passes through a first bearing means supported by said first inner wall and engages said electromagnetic clutch assembly, and passes through a second bearing means supported by said second inner wall and engages said second large diameter spur gear;

said first gear shaft passes through a third bearing means supported by said third inner wall; and said drive shaft passes through a fourth bearing means supported by said fourth inner wall.

36. The remotely controllable retractable lifeline extending safety device disclosed in claim 35, wherein:

said roller pivot engages said first inner wall and said second inner wall of said lifeline extension assembly housing.

* * * * *